United States Patent [19]

Takenoshita et al.

[11] 4,249,641

[45] Feb. 10, 1981

[54] SPEED CONTROL SYSTEM FOR HYDRAULIC ELEVATOR

[75] Inventors: Mitsuaki Takenoshita; Masayuki Shigeta, both of Katsuta, Japan

[73] Assignee: Hitachi, Ltd., Japan

[21] Appl. No.: 960,613

[22] Filed: Nov. 14, 1978

[51] Int. Cl.[3] ..... B66B 1/00

[52] U.S. Cl. ..... 187/29 A; 318/84

[58] Field of Search ..... 187/29 A, 29 B, 17, 187/38, 39, 68; 318/84

[56] References Cited

U.S. PATENT DOCUMENTS

| | | | |
|---|---|---|---|
| 2,266,240 | 12/1941 | Nyberg | 187/29 B |
| 2,565,880 | 8/1951 | Pettengill et al. | 187/29 A |
| 3,955,649 | 5/1976 | Takenoshita et al. | 187/29 A |
| 4,148,248 | 4/1979 | Risk | 187/17 |

*Primary Examiner*—Stanley H. Tollberg
*Assistant Examiner*—Kenneth Noland
*Attorney, Agent, or Firm*—Craig & Antonelli

[57] ABSTRACT

A speed control system for a hydraulic elevator, in which, actuating a hydraulic pump by driving an induction motor in forward direction, oil is supplied to a hydraulic cylinder for upward travel of an elevator cage, while the hydraulic pump is driven to discharge the oil from the hydraulic cylinder by driving the induction in reverse direction for downward travel of the cage. The induction motor is a single two-speed motor, which is switched to drive the hydraulic pump in one of the two speeds as desired, thus subjecting the elevator cage to two-speed control.

5 Claims, 4 Drawing Figures

SPEED CONTROL SYSTEM FOR HYDRAULIC ELEVATOR

BACKGROUND OF THE INVENTION

This invention relates to a speed control system for a hydraulic elevator of the type which comprises a hydraulic jack including a vertically extending cylinder and a plunger vertically movable therein, a hydraulic system including a hydraulic pump for applying hydraulic pressure to the cylinder, and operative to control the hydraulic pressure applied to the cylinder for controlling the vertical movement of the plunger in the cylinder, and an elevator cage operatively connected to the plunger so that it is moved upward or downward with the vertical movement of the plunger. In one of the well-known speed control systems for such a type of hydraulic elevator, the speed control is carried out in such a manner that for upward travel, a part of the oil discharged by the hydraulic pump is bled off in a controlled manner to regulate the amount of oil supplied to the cylinder, while for down travel, the hydraulic pump is deactivated and the amount of oil discharged from the hydraulic cylinder through a return pipe by the weight of the elevator cage and plunger is regulated by a flow control valve provided in the return pipe. Such a speed control system is disclosed, for example, in U.S. Pat. No. 3,955,649 issued May 11, 1976 to Mitsuaki Takenoshita et al. and entitled "Device for Correcting Floor Level of Hydraulic Elevator" and U.S. Pat. No. 3,892,292 issued July 1, 1975 to Mitsuaki Takenoshita et al. and entitled "Hydraulic Elevators."

The speed control system of this type has disadvantages in that pressure loss in the flow control valve is converted into heat energy, thereby increasing the temperature of the oil in the hydraulic system. The temperature of oil in the hydraulic system is generally required to be held at or below 60° C. At higher temperatures than this, oil viscosity is reduced, the flow rate of the oil flowing in the pipe changes, thus changing the moving speed of the plunger of the hydraulic jack, with the result that the running speed of the elevator cage is changed, thereby making difficult accurate landing of the cage at the desired floor level. This necessitates a large-sized cooler for preventing the temperature of the oil from increasing higher than a predetermined level. Provision of a large-sized cooler increases the cost of installation and maintenance. Further, in the cast of the cooler being of the air-cooled type, noises and required space are increased, and in the case of the water-cooled type of cooler, limitation of water use in dry seasons may prevent the operation of the hydraulic elevator.

To obviate such disadvantages, a recently suggested speed control system comprises two types of hydraulic pumps, one for high speed and the other for low speed, without any flow rate control valve. The use of two hydraulic pumps and motors, however, undesirably increases the space occupied by a power unit constituting a hydraulic pressure source on the one hand and the installation cost on the other hand. Also, the fact that the oil flows discharged from the two hydraulic pumps are used in combination for the purpose of speed control results in the disadvantageous necessity of complicated regulation at acceleration or deceleration.

SUMMARY OF THE INVENTION

Accordingly, it is an object of the present invention to provide a low-cost speed control system for a hydraulic elevator, which has a hydraulic system with the oil temperature thereof not increased considerably in low-speed operation of the elevator which requires no large-sized cooler, and is capable of achieving smooth acceleration and deceleration characteristics.

Another object of the present invention is to provide a low-cost speed control system for a hydraulic elevator, in which the space occupied by the power unit is reduced and smooth acceleration and deceleration characteristics are obtained.

According to the present invention, a speed control system is provided to be used with a hydraulic elevator of the type in which an elevator cage is carried by a vertically extending plunger which is mounted in a vertically extending hydraulic cylinder to move therein upward or downward, selectively, by applying to or discharging from the hydraulic cylinder a pressurized fluid through a hydraulic pump which is movable selectively with forward or reverse rotation, and to comprise a three-phase induction motor capable of being driven in a forward or reverse way for driving the hydraulic pump, the motor including a set of three-phase windings and being capable of being driven at high or low speed selectively by changing the number of poles of the windings; fluid path means providing a fluid path for connecting the hydraulic cylinder to a fluid source through a hydraulic pump in order to supply to or discharge from the hydraulic cylinder pressurized fluid by the hydraulic pump; direction selector means for selecting the direction of rotation of the three-phase induction motor in accordance with the direction of travel of an elevator cage in a manner that the hydraulic pump is operated in a forward direction for upward travel of the elevator cage and in a reverse direction for down travel thereof; and speed control means for controlling the running speed of the elevator cage, the speed control means including pole-number changing means for changing the number of the poles of the windings of the three-phase motor in accordance with whether the cage should be run at high or low speed, in such a manner that the hydraulic pump is driven at high speed for high speed running of the elevator cage and at low speed for low speed running thereof.

DESCRIPTION OF THE PREFERRED EMBODIMENT

Figure 1:
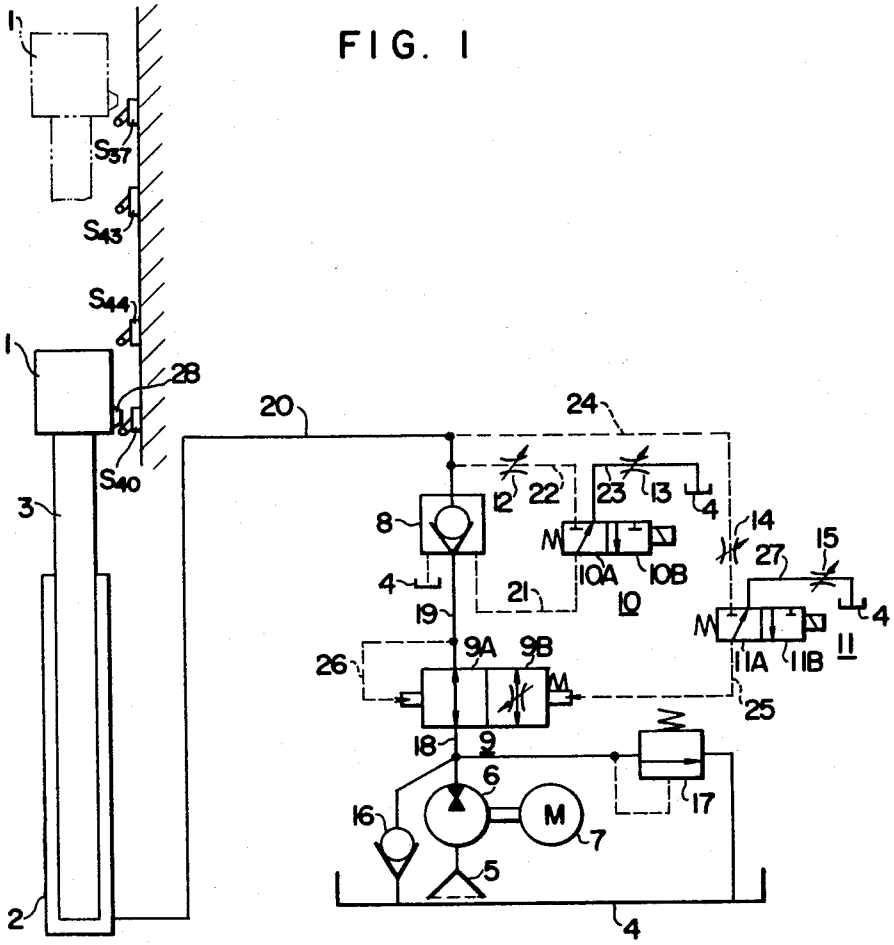
FIG. 1 is a diagram showing the hydraulic system of an embodiment of the present invention.

In FIG. 1, reference numeral 2 shows a hydraulic cylinder, numeral 3 a plunger movable vertically in the hydraulic cylinder 3, and numeral 1 an elevator cage vertically movable with the vertical movement of the plunger. Although the elevator cage 1 is shown secured to the plunger 3, it will be obvious that as disclosed in U.S. Pat. No. 3,955,649, the elevator cage may be suspended from one end of a wire rope carried by a pulley, the other end of which is secured to the plunger. The hydraulic system for vertically driving the cylinder includes an oil tank 4, a strainer 5, an oil pump 6, an oil pump driving motor 7, an oil pressure switching valve 9, a pilot check valve 8, all of which are connected in series by main pipe paths 18, 19 and 20 for making up an oil path from the oil tank to the plunger. The hydraulic system further includes a suction valve 16, a relief valve 17, solenoid valves 10, 11, chokes 12, 13, 14, 15, pilot tubes 21, 22, 24, 25, 26 and return tube paths 23, 27. The operation of this hydraulic system will be described in detail later.

Figure 2:
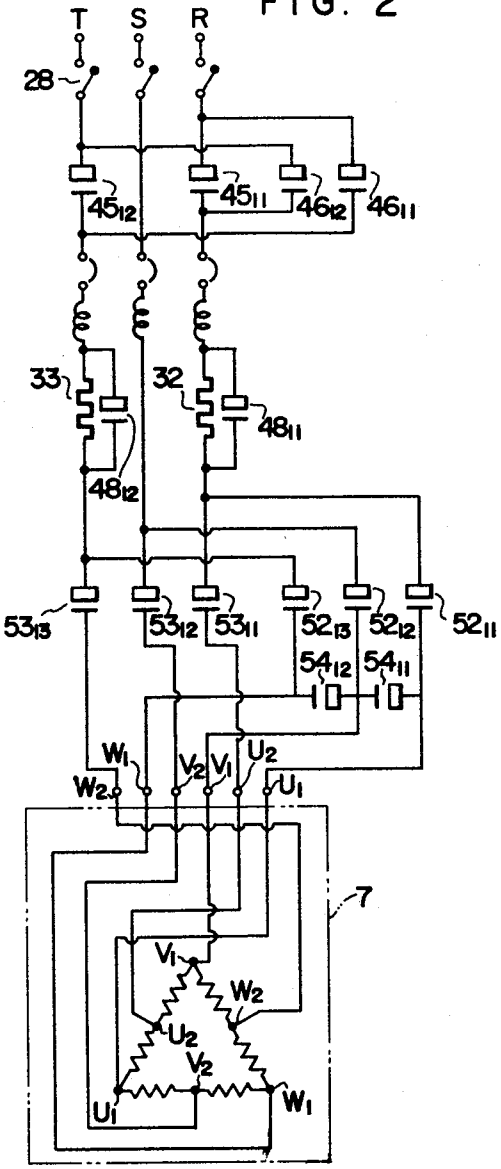
FIG. 2 shows a main electrical circuit for operating the hydraulic system shown in FIG. 1.
Figure 3:
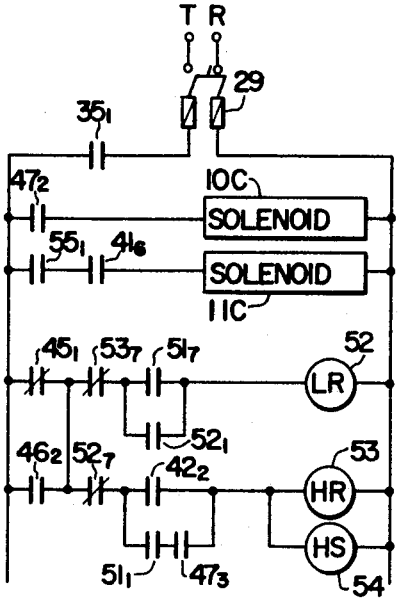
FIGS. 3 and 4 are diagrams showing electrical control circuits for operating the hydraulic system of FIG. 1.
Figure 4:
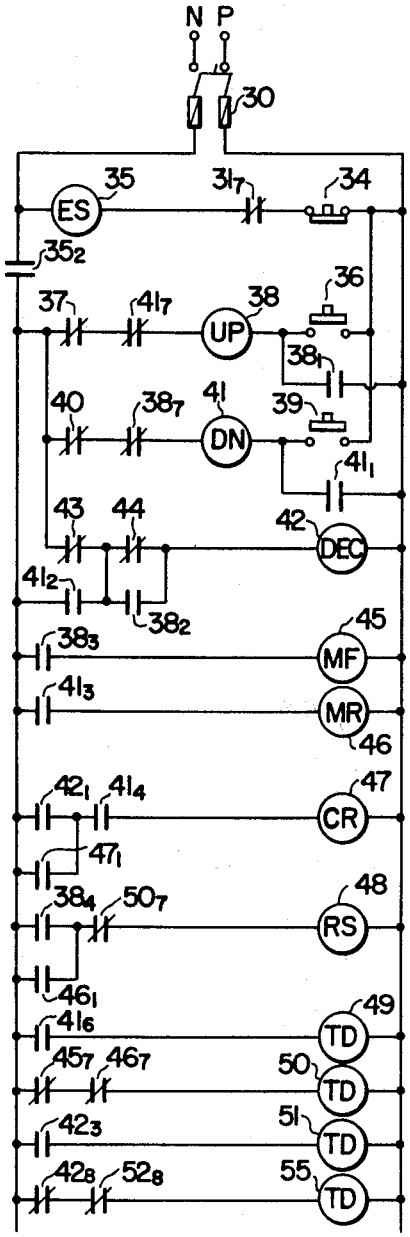

FIGS. 2, 3 and 4 show a main electrical circuit and a control circuit for driving the hydraulic system. In the drawings, characters T, S and R show main circuit power terminals connected to a three-phase power supply (not shown), characters N and P control power terminals connected to a DC power supply (not shown), numerals 28, 29 and 30 power switches, numeral 31 an overcurrent circuit breaker, 32, 33 starting resistors, numeral 34 an emergency stop switch, numeral 35 an emergency stop relay, numeral 36 an up travel command switch, numeral 37 a contact of an up travel stop switch $S_{37}$ provided at a predetermined position in the cage hoistway for stopping the elevator cage 1 moving upward, numeral 38 an up travel relay, numeral 39 a down travel command switch, numeral 40 a contact of a down travel stop switch $S_{40}$ provided at a predetermined position in the hoistway for stopping the cage 1 moving downward, numeral 41 a down travel relay, numeral 42 a deceleration relay, numeral 43 a contact of an upward deceleration switch $S_{43}$ provided in the hoistway for decelerating the cage 1 moving upward, numeral 44 a contact of a down travel deceleration switch $S_{44}$ provided in the hoistway for decelerating the elevator cage 1 moving downward, numerals 45, 46 main forward and reverse relays for driving the motor 7 in forward and reverse directions respectively, numeral 47 a relay, numeral 48 a short-circuiting relay for shorting the resistors 32 and 33, numerals 49, 50 and 51 time relays, numeral 52 a low-speed main relay with an auxiliary contact for closing the main circuit contacts $52_{11}$, $52_{12}$ and $52_{13}$ when the motor 7 is to be driven at low speed, numerals 53 and 54 high-speed main relays for closing main circuit contacts $53_{11}$, $53_{12}$, $53_{13}$ and short-circuiting contacts $54_{11}$, $54_{12}$, respectively, when the motor 7 is to be driven at high speed, numeral 55 a time relay, numeral 10C a solenoid coil of the solenoid valve 10, and numeral 11C a solenoid coil of the solenoid valve 11. The contacts of the abovementioned relays are denoted by the same reference numerals as those of the corresponding relays, with suffixes 1 to 8 attached to them respectively.

In the embodiment shown in the drawings, it is assumed, by way of explanation, that the elevator cage moves between a first floor position shown by a solid line and a second floor position shown by a dotted line without stopping, under normal operating conditions, at an intermediate position there between. It will, however, be easily understood by those skilled in the art that the circuit may be modified in such a manner that the cage may be stopped at any one of a plurality of predetermined floor positions in the case where more than two floors are involved and that such a modification is also of course included in the scope of the present invention.

The most important feature of the present invention is that a single-winding two-speed three-phase induction motor is preferably used as the hydraulic pump motor 7. As shown in FIG. 2 by way of example, the motor 7 has three-phase windings $U_1V_1$; $V_1W_1$; $W_1U_1$ from which intermediate taps $U_2$, $W_2$, $V_2$ are taken out. If the taps $U_2$, $V_2$, $W_2$ are connected to a three-phase power supply with $U_1$, $V_1$, $W_1$ short-circuited at contacts $54_{11}$, $54_{12}$, the motor 7 is driven as a three-phase motor with P poles. If $U_1$, $V_1$, $W_1$ are connected to a three-phase power supply with $U_2$, $W_2$,$V_2$ opened, on the other hand, the motor 7 is driven as a three-phase motor with 2P poles. The motor speed in the latter case is one half of the former case. Explanation will be made now of the operation of the system according to the present invention using the hydraulic pump driving motor of two speed type mentioned above.

When the switches 28, 29 and 30 are closed, the circuit including P, 34, $31_7$, coil of relay 35 and N is formed, so that the coil of the relay 35 is excited, thereby operating the relay 35. By the operation of the relay 35, the contacts $35_1$ and $35_2$ are closed, thus energizing both the control circuits of FIGS. 3 and 4. On the other hand, the circuits including P, coil of time relay 50, $46_7$, $45_7$, $35_2$, N, and P, coil of time relay 55, $52_8$, $42_7$, $35_2$ and N are energized, so that the coils of the time relays 50 and 55 are excited, thus energizing the contacts of the time relays 50 and 55 with predetermined time delay. As a result, all the circuits are ready for operation.

I. Up travel (1) First, assume that the cage 1 is located at the first position shown by the solid line. Closing the up travel command switch 56, the circuit through P, coil of relay 38, $41_7$, 37, $35_2$ and N is energized and the coil of the relay 38 excited, thus actuating the relay 38. In response to the actuating of relay 38, the circuit through P, coil of relay 42, $38_2$, 43, $35_2$, N, P, coil of main relay 45, $38_3$, $35_2$ and N is energized, so that the coils of relay 42 and main relay 45 are excited, thus actuating the contacts of relay 42 and main relay 45. Thus the circuit including R, coil of main relay 53 (coil of main relay 54), $42_2$, $52_7$, $45_1$, $35_1$ and T is energized, so that the coils of main relay 53 and main relay 54 are excited, thus actuating the contacts of main relays 53 and 54. As a result, the terminals $U_2$, $V_2$, $W_2$ of the motor 7 are connected to the power supplies R, S, T, while the terminals $U_1$, $V_1$, and $W_1$ are short-circuited with each other to provide p-pole winding connection, thus starting the motor 7 with the starting resistors 32 and 33 inserted in the power circuit. The oil pump 6 is thus driven. As described later, the hydraulic pressure switching valve 9 is located at the shown position in such a way that the straight tube portion 9A connects the main tubes 18 and 19. When the oil pump 6 is driven, therefore, oil in the oil tank 4 is supplied to the hydraulic cylinder 2 through the main tube path 18, oil pressure switching valve 9, main tube path 19, pilot check valve 8 and main tube path 20, thus urging the plunger upward, resulting in the upward movement of the cage 1. In response to the actuation of the main relays 42 and 45, on the other hand, the contacts $42_7$ and $45_7$ open, and therefore the time relays 50 and 55 are de-energized with the result that the normally-closed contact $50_7$ is closed with predetermined time delay. Thus the circuit through P, coil of relay 48, $50_7$, $38_4$, $35_2$ and N is energized and the coils of the resistor-shorting relay 48 is excited, thus closing the contacts $48_{11}$ and $48_{12}$ thereof. The resistors 32 and 33 are short-circuited, so that the rated voltage is applied to the motor 7, which is thus accelerated at the rated speed for P poles. Accordingly, the pump 6 is driven at rated speed, thus supplying the hydraulic cylinder 2 with the rated full amount of oil of the pump 6. Thus the cage 1 is accelerated and moves upward at the rated speed with P poles, i.e., at high speed.

(2) When the cage 1 moving a high speed approaches the second position shown by dotted line in FIG. 1, the deceleration switch $S_{43}$ is energized by the actuator 28 mounted on the cage 1. The switch $S_{43}$ is so positioned that it is energized when the cage 1 traveling up at high speed reaches a deceleration starting position determined to assure accurate stoppage of cage 1 at the second position. With the actuation of the switch $S_{43}$, the contact 43 thereof is opened and therefore the deceleration relay 42 is de-energized, thus opening the contact $\mathbf{42}_2$ thereof. The high-speed relays 53 and 54 are de-energized, so that the contacts $\mathbf{53}_{11}$, $\mathbf{53}_{12}$, $\mathbf{53}_{13}$, $\mathbf{54}_{11}$ and $\mathbf{54}_{12}$ thereof open, thus cutting off the motor 7 from the power supply.

Since the de-energization of relay 53 causes the contact $\mathbf{53}_7$ thereof to be closed, the low-speed relay 52 is energized, so that the contacts $\mathbf{52}_{11}$, $\mathbf{52}_{12}$ and $\mathbf{52}_{13}$ are closed. Thus the terminals $U_1$, $V_1$, $W_1$ of the motor 7 are connected to the power supplies R, S, T, the motor 7 being driven with 2P poles, i.e., at low speed since the terminals $U_2$, $V_2$ and $W_2$ are open.

In the above-mentioned operation, in response to the opening of the main relays 53 and 54, the motor 7 assumes the state of no excitation and fails to receive rotational torque but continues to rotate due to inertia. Immediately after that, the main relay 52 is actuated, thus making possible low-speed operation during deceleration.

The rotational speed of the pump 7 is reduced, and the amount of oil supplied from the pump 7 to the hydraulic cylinder 2 decreases, so that the elevator cage 1 is decelerated and rendered ready at low speed for arrival at a floor. In the electrical control circuit, on the other hand, the deceleration relay 42 is de-energized and the contact $\mathbf{42}_3$ thereof is opened, so that the time relay 51 is de-energized and the contact $\mathbf{51}_7$ thereof is opened with predetermined delay time but the main relay 52 is held by the self-holding contact $\mathbf{52}_1$.

(3) When the cage 1 moving up at low speed reaches a point immediately before a stationary position (second position), the switch $S_{37}$ is turned on by the actuator 28, and the contact 37 thereof is opened. The up travel relay 38 is de-energized, opening the contact $\mathbf{38}_3$ thereof; the relay 45 is de-energized, thus opening the contact $\mathbf{45}_1$ thereof; and the relay 52 is de-energized, thus opening the contacts $\mathbf{52}_{11}$, $\mathbf{52}_{12}$ and $\mathbf{52}_{13}$ thereof, so that the motor 7 is cut off from power supply and stops. As a result, oil supply from pump to hydraulic cylinder 2 is stopped, thus stopping the cage 1 at the second position.

II. Down travel

Next, explanation will be made of the circuit operation in the case where the cage 1 is moved down from the second position shown by dotted line in FIG. 1. Since relay 35 is kept energized, the time relays 50 and 55 remain actuated.

(1) When the down travel command switch 39 is depressed, the circuit including P, 39, coil of down travel relay 41, $\mathbf{38}_7$, 40, $\mathbf{35}_2$ and N is energized, so that the relay 41 is actuated and the contacts $\mathbf{41}_2$, $\mathbf{41}_3$, $\mathbf{41}_5$ and $\mathbf{41}_6$ are closed. The circuit including P, coil of relay 42, 44, $\mathbf{41}_2$, $\mathbf{35}_2$, N, P, coil of main relay 46, $\mathbf{41}_3$, $\mathbf{35}_2$, N, P, coil of time relay 42, $\mathbf{41}_5$, $\mathbf{35}_2$, N, R, solenoid coil 11C, $\mathbf{41}_6$, $\mathbf{55}_1$, $\mathbf{35}_1$ and T is energized, with the result that the relay 42, main relay 46, time relay 49 and solenoid 11C are actuated. With the actuation of the main relay 46, the contacts $\mathbf{46}_{11}$ and $\mathbf{46}_{12}$ are closed and the three-phase power circuit of the motor 7 becomes ready for operation. It should be noted that as compared with the phase rotation for the up travel where the contacts $\mathbf{45}_{11}$ and $\mathbf{45}_{12}$ are closed, the phase rotation of the three-phase power supply circuit of the motor is reversed in the down travel. Thus during down travel, the motor is driven in the direction reverse to that for up travel. Energization of the solenoid 11C causes the solenoid valve 11 to be actuated. As long as the solenoid 11C is not energized, the solenoid valve 11 is in the condition as shown in FIG. 1 by the spring force, so that the pilot tube 25 is connected to the return valve 27 through the first tube path 11A of the solenoid valve 11. The hydraulic pressure in the pilot tube 25 therefore is at low level and the hydraulic pressure switching valve is held at the shown position by the spring force. Upon energization of solenoid 11C, the electromagnetic force thereof causes the solenoid valve 11 to move from the shown position against the spring force, and the second tube path 11B moves to a position for connecting the pilot tubes 25 and 24. Hydraulic pressure in the main tube path is imparted to the hydraulic pressure switching valve 9 via the pilot valve 25. The switching valve 9 is moved from the shown position against the spring force, so that the main tubes 18 and 19 are connected to each other through the choke 9B of the switching valve 9.

Since the contact $\mathbf{42}_1$ is closed by the actuation of the relay 42, the relay 47 is energized and the contact $\mathbf{47}_2$ thereof is closed. The solenoid 10C is energized, thus energizing the solenoid valve 10. The solenoid valve 10 has substantially the same function as the solenoid valve 11. When the solenoid 10C is not energized, the solenoid valve is situated at the shown position. The pilot tube 21 is connected to the return tube 23 through the first tube path 10A. When the solenoid 10C is energized, on the other hand, the solenoid valve 10 is energized and the pilot tube 21 is connected to the pilot tube 22 through the second tube path 10B. As a result, hydraulic pressure is applied to the pilot check valve 8 through the pilot tube 21, so that the pilot check valve 8 opens the way also from the main tube path 20 to the main tube path 19.

Further, by energization of relays 46 and 42, the contacts $\mathbf{46}_2$ and $\mathbf{42}_2$ are closed. Therefore, the relays 53 and 54 sre actuated and the contacts $\mathbf{53}_{11}$, $\mathbf{53}_{12}$, $\mathbf{53}_{13}$, $\mathbf{54}_{11}$, and $\mathbf{54}_{12}$ are closed. Thus the terminals $U_2$, $V_2$, $W_2$ of the motor 7 with the terminals thereof $U_1$, $V_1$, $W_1$ short-circuited are connected to the three-phase power supplies T, S, R, through the starting resistors 32 and 33. The motor 7 is thus driven in the direction reverse to that for up travel, with P poles thereof connected.

As a result, the oil in the hydraulic cylinder 2 is discharged to the oil tank 4 through the main tube path 20, pilot check valve 8, main tube 19, oil pressure switching valve 9, main tube path 18 and pump 6 by the pressure caused by the own weight of the cage 1 and plunger 3, so that the plunger 3 moves down and the cage 1 travels down. In response to the actuation of the relay 42 and main relay 46, on the other hand, the contacts thereof $\mathbf{42}_7$ and $\mathbf{46}_7$ open and the time relays 50 and 55 are de-energized, so that the relay contact $\mathbf{50}_7$ and contact $\mathbf{55}_1$ are restored to their closed and open states respectively with predetermined time delay. First, the opening of the relay contact $\mathbf{55}_1$ causes the solenoid 11C to be de-engergized, the solenoid valve 11 is returned to the shown position, the hydraulic pressure in the pilot tube 25 is reduced, and therefore the oil pressure switching valve 9 is also restored to the shown position. Thus the choke 9B is replaced by the straight tube path 9A with a larger sectional area of the opening of connecting the main tube paths 18 and 19. On the other hand, when the contact $50_7$ is closed, the relay 48 is energized and the contacts thereof $48_{11}$ and $48_{12}$ are closed, so that the starting resistors 32 and 33 are short-circuited, thus accelerating the motor 7.

In the above-mentioned processes of operation, immediately after the motor is started, the motor is driven at low speed by the starting resistors 32 and 33 and the choke 9B of the oil pressure switching valve is inserted in the main tube path. Thus the flow resistance of the return oil path from the cylinder to the oil tank through the main tube path is large and therefore the flow rate of the pressurized oil is small, so that the plunger moves down at low speed. When with the short-circuiting of the starting resistors 32 and 33, the motor 7 is driven at high speed with P poles and the straight tube path 9A of the oil pressure switching valve is inserted into the main tube path, the resistance of the oil path is reduced and the flow rate of the pressurized oil is increased, thus increasing the downward speed of the plunger.

(2) When the cage 1 traveling down at high speed approaches the first position shown by the solid line in FIG. 1, the down travel deceleration switch $S_{44}$ is actuated by the actuator 28. The down travel deceleration switch $S_{44}$ is so positioned that it is actuated when the cage moving down at high speed reaches a deceleration-starting point determined to stop the cage at the first position accurately. By the actuation of switch $S_{44}$, the normally-closed contact 44 is opened and the deceleration relay 42 is energized. As a result, the contact $42_7$ of the relay 42 is closed. The circuit through P, coil of the time relay 55, $52_8$, $42_7$, $35_2$ and N is energized, so that the time relay 55 is actuated and the contact $55_1$ thereof is closed. The circuit through R, solenoid 11C, $41_6$, $55_1$ and T is energized. The solenoid 11C is excited and the solenoid valve 11 is actuated. In response to the actuation of the solenoid valve 11, the oil pressure switching valve 9 is actuated to locate the choke 9B with small opening area, in place of the straight tube path 9A, between the main tube paths 18 and 19. Upon de-energization of the deceleration relay 42, on the other hand, the contact $42_2$ is opened, the high speed relays 53 and 54 are de-energized, and the contacts thereof $53_{11}$, $53_{12}$, $53_{13}$, $54_{11}$ and $54_{12}$ are opened, thus cutting off the motor 7 from the power supply. Upon de-energization of the relay 53, the contact $53_7$ thereof is closed. The de-energization of the relay 42, on the other hand, opens the contact $42_3$, thus de-energizing the time relay 51. The normally-closed contact $51_7$ is thus closed with predetermined time delay, while the contact $53_7$ is already closed. Thus the low-speed relay 52 is energized, and the contacts thereof $52_{11}$, $52_{12}$ and $52_{13}$ are closed. The terminals $U_1$, $V_1$, $W_1$ of the motor 7 are connected to the power circuit while the terminals $U_2$, $V_2$ and $W_2$ are open, and therefore the motor 7 is driven at low speed with 2P poles.

The energization of the relay 52 causes the contact thereof $52_8$ to open, thus de-energizing the time relay 55. So, the contact thereof $55_1$ is opened with predetermined time delay, and the solenoid 11C is de-energized. As a result, the solenoid valve 11 is restored to the position shown in the drawing. The pilot tube is connected via the tube path 11B to the return tube 27, and the oil pressure therein is reduced, so that the oil pressure switching valve 9 is restored also to the shown position. As a result, the main tube paths 18 and 19 are again connected to each other by the straight tube path 9A with large sectional area of the opening thereof.

As described above, when the cage 1 reaches the deceleration position, the oil pressure switching valve 9 is actuated so that the main tube paths are connected by the choke 9B, while at the same time cutting the motor 7 from the three-phase power supply. With a predetermined time delay, the motor 7 is connected to the power supply with 2P poles. During the short period from the time when the motor 7 is cut off from power supply to the time when it is again connected to the power supply, the hydraulic pump is free to rotate, thus losing the braking function of the hydraulic pump against the oil flow from cylinder to oil tank through the main tube paths. Instead, the braking function is given by the choke 9B during that period with actuation of the oil pressure switching valve 9. The motor 7 with 2P poles thereof connected is connected to the power supply and driven at low speed, so that the hydraulic pump is also driven at low speed. When the motor 7 is connected to the power supply, on the other hand, the oil pressure switching valve is restored to again the shown position with a predetermined time delay, so that the straight tube path 9A is inserted into the main tube paths. Thus, by the braking function due to the low-speed operation of the hydraulic pump, the amount of oil discharged from the hydraulic cylinder 2 through the oil pump is reduced and therefore the plunger 3 is moved downward at low speed, thereby the cage getting ready for floor landing.

(3) When the cage 1 moving at low speed reaches a stop position, i.e., a point immediately before the first position shown in the drawing, the down travel stop switch $S_{40}$ is actuated by the actuator 28, and the contact 40 is opened, thus de-energizing the relay 41. Then, the main reverse relay 46 is de-energized, resulting in opening the main contacts $46_{11}$ and $46_{12}$, thereby stopping the pump motor.

In the event that oil pressure in the main tubes rises abnormally when the motor 7 driven in forward direction causes the hydraulic pump to suck oil from the oil tank into the cylinder 2, i.e., at the time of up travel, the relief valve 17 works in response to that oil pressure in such a manner that part of the oil is returned to the oil tank 4, thus preventing a further rise of oil pressure. The suction valve 16, on the other hand, is provided for preventing the oil pressure at pump suction side from dropping further by causing the oil pump 6 to suck up the oil from the oil tank 4 when the motor 7 driven in reverse direction causes the oil pump 6 to supply oil to the oil tank 4 from the main tubes, i.e., at the time of down travel.

In the above-mentioned embodiment, the pilot check valve 8 is arranged in series with the oil pressure switching valve 9 to prevent overspeed at the time of switching between high and low speeds. Instead of such an arrangement, the pilot check valve 8 may be incorporated in the oil pressure switching valve 9 with equal effect.

It will be understood from the foregoing description that according to the present invention two-speed control is effected by use of a single two-speed motor and a hydraulic pump. Thus the power unit is constructed in compact form on the one hand and the installation cost is lower on the other hand, thus reducing the overall cost.

We claim:

1. A speed control system for a hydraulic elevator of the type in which an elevator cage is moved in response to a vertically extending plunger which is mounted in a hydraulic cylinder to move therein upward or downward, selectively, by applying to or discharging from the hydraulic cylinder a pressurized fluid through a hydraulic pump, which may be driven selectively with forward or reverse rotation, said speed control system comprising:

a three-phase induction motor capable of being driven in forward or reverse direction in driving connection with said hydraulic pump, said motor including a set of three-phase windings and being capable of being driven at high or low speed selectively by changing the configuration of the connection thereof to a power supply to change the number of poles of the windings;

fluid path means providing a fluid path connecting said hydraulic cylinder to a fluid source through said hydraulic pump in order to supply to or discharge from said hydraulic cylinder pressurized fluid through said hydraulic pump;

direction selector means connected to said three-phase windings for selecting the direction of rotation of said three-phase induction motor in accordance with the direction to which the elevator cage is to travel in a manner that said hydraulic pump is operated in a forward direction for upward travel of the elevator cage and in a reverse direction for downward travel thereof; and speed control means connected to said three-phase windings for controlling the running speed of said elevator cage, said speed control means including pole-number changing means for changing the connections of said windings to a power supply and thereby changing the number of the poles of said windings of said three-phase induction motor in accordance with whether the cage is to be run at high or low speed, in such a manner that said hydraulic pump is driven at high speed for high speed running of the elevator cage and at low speed for low speed running thereof.

2. A speed control system according to claim 1, wherein said fluid path means incudes a controllable check valve in said fluid path which operates normally in such a manner that the pressurized fluid is permitted to flow from said hydraulic pump toward said hydraulic cylinder and prevented from flowing from said hydraulic cylinder toward said hydraulic pump, and check valve control means for controlling said check valve to permit the pressurized fluid to flow from said hydraulic cylinder toward said hydraulic pump in response to the selection of down travel of said elevator cage by said direction selector means.

3. A control system according to claim 1 or 2, wherein said fluid path means includes valve-switching means inserted in said fluid path and movable between a first position and a second position for forming a fluid path with a smaller sectional area in said second position than in said first position, said speed control means including valve switching control means for moving said valve switching means to said second position only during the transient period when said hydraulic pump is switched from high speed to low speed operation during downward travel of said cage.

4. A speed control system for a hydraulic elevator of the type in which an elevator cage is carried by a vertically extending plunger mounted in a hydraulic cylinder to move therein upward or downward, selectively, by appling to or discharging from the hydraulic cylinder a pressurized fluid through a hydraulic pump, said speed control system comprising:

an induction motor for driving said hydraulic pump in a forward or a reverse direction selectively and having pole-changing windings to be driven at high or low speed, selectively, by changing the number of poles of the windings;

fluid path means for providing a fluid path for a pressurized fluid between said hydraulic cylinder and a fluid source through said hydraulic pump;

direction selector means for selecting the direction of rotation of said induction motor so that the pressurized fluid is applied through said fluid path to said hydraulic cylinder when said cage is to move upward and is discharged through said fluid path from said hydraulic cylinder when said cage is to move downward;

speed controlling means for controlling the moving speed of said elevator cage and including means for changing the number of poles of the windings of said induction motor in accordance with whether said induction motor is to be driven at the high speed thereby moving said cage at its high speed or at the low speed thereby moving said cage at its low speed; and means normally operative to cause said speed controlling means to drive said induction motor at its high speed after starting and causing, when said cage reaches a predetermined position before a stop position where said cage is to be stopped, said speed controlling means to drive said induction motor at its low speed.

5. A control system according to claim 4, wherein said fluid path means includes valve-switching means inserted in said fluid path and movable between a first position and a second position for forming a fluid path with a smaller sectional area in said second position than in said first position, said speed control means including valve switching control means for moving said valve switching means to said second position only during the transient period when said hydraulic pump is switched from high speed to low speed operation during downward travel of said cage.

* * * * *